US010321236B2

(12) United States Patent
Wan et al.

(10) Patent No.: US 10,321,236 B2
(45) Date of Patent: Jun. 11, 2019

(54) LOUDSPEAKER MODULE

(71) Applicant: GOERTEK INC., Weifang (CN)

(72) Inventors: Ling Wan, Weifang (CN); Hua Shi, Weifang (CN)

(73) Assignee: GOERTEK INC., Weifang (CN)

( * ) Notice: Subject to any disclaimer, the term of this patent is extended or adjusted under 35 U.S.C. 154(b) by 57 days.

(21) Appl. No.: 15/327,651

(22) PCT Filed: Jun. 30, 2015

(86) PCT No.: PCT/CN2015/082938
§ 371 (c)(1),
(2) Date: Jan. 19, 2017

(87) PCT Pub. No.: WO2016/078413
PCT Pub. Date: May 26, 2016

(65) Prior Publication Data

US 2017/0208395 A1 Jul. 20, 2017

(30) Foreign Application Priority Data

Nov. 20, 2014 (CN) ..... 2014 1 0668527

(51) Int. Cl.
*H04R 1/02* (2006.01)
*H04R 9/06* (2006.01)
(Continued)

(52) U.S. Cl.
CPC ..... *H04R 9/06* (2013.01); *H04R 7/127* (2013.01); *H04R 9/02* (2013.01); *H04R 9/025* (2013.01);
(Continued)

(58) Field of Classification Search
CPC ..... H04R 2201/00; H04R 2201/02; H04R 2201/025; H04R 2201/029; H04R 2400/11; H04R 2499/11
See application file for complete search history.

(56) References Cited

U.S. PATENT DOCUMENTS 6,422,086 B1 * 7/2002 Dromms ..... A61B 5/021 73/715
6,633,420 B2 * 10/2003 Huang ..... H01R 12/7076 174/53
(Continued)

FOREIGN PATENT DOCUMENTS

CN 201540507 U 8/2010
CN 201813525 U 4/2011
(Continued)

OTHER PUBLICATIONS

International Search Report dated Sep. 1, 2015 for PCT Application No. PCT/CN2015/082938.
(Continued)

*Primary Examiner* — Duc Nguyen
*Assistant Examiner* — Kile Blair
(74) *Attorney, Agent, or Firm* — Moser Taboada

(57) ABSTRACT

A loudspeaker module comprising a module casing. A loudspeaker unit body (30) is accommodated within the module casing. The loudspeaker unit body (30) comprises a unit body front cover (32) and a unit body casing (34) which are combined with each other. A vibration system and a magnetic circuit system are accommodated within a space enclosed by the unit body front cover (32) and the unit body casing (34). A plurality of positioning columns (340) are arranged outside sidewalls of the unit body casing (34). Each of the positioning columns (340) protrudes out of the surface of the sidewall of the unit body casing (34), and extends from the upper end of the unit body casing (34) to the lower
(Continued)

end of the unit body casing (34) along the sidewall of the unit body casing (34). Positioning bosses (22) are individually arranged at positions on the module casing corresponding to the positioning columns (340). Positioning holes (222) which are adapted for the positioning columns (340) are individually vertically arranged on the positioning bosses (22). The positioning structure for a unit body of the loudspeaker module is small, and occupies smaller space. The module has high acoustic performances, and the assembly process of the module is simple and easy to operate.

11 Claims, 2 Drawing Sheets

(51) Int. Cl.
*H04R 9/02* (2006.01)
*H04R 7/12* (2006.01)
*H04R 31/00* (2006.01)

(52) U.S. Cl.
CPC ..... *H04R 31/006* (2013.01); *H04R 1/021* (2013.01); *H04R 2499/11* (2013.01)

(56) References Cited

U.S. PATENT DOCUMENTS

| | | | | |
|---|---|---|---|---|
| 7,694,419 | B2 * | 4/2010 | Diehl | A61C 17/225 30/526 |
| 9,149,221 | B2 * | 10/2015 | Kan | A61B 5/15117 |
| 9,338,535 | B2 * | 5/2016 | Shao | H04R 9/10 |
| 2011/0170727 | A1 * | 7/2011 | Akino | H04R 3/005 381/361 |
| 2013/0070943 | A1 * | 3/2013 | Chang | H04R 1/023 381/189 |
| 2013/0156237 | A1 | 6/2013 | Kim | |

FOREIGN PATENT DOCUMENTS

| | | | |
|---|---|---|---|
| CN | 202059701 | U | * 11/2011 |
| CN | 202799033 | U | 3/2013 |
| CN | 202841449 | U | 3/2013 |
| CN | 203466939 | U | 3/2014 |
| CN | 203618099 | U | 5/2014 |
| CN | 203788426 | U | 8/2014 |
| CN | 203840523 | U | 9/2014 |
| CN | 203883987 | U | 10/2014 |
| CN | 204231647 | U | 3/2015 |
| CN | 104540076 | A | 4/2015 |
| JP | 2005223720 | A | 8/2005 |
| JP | 2007336338 | A | 12/2007 |
| KR | 101187510 | B1 | 10/2012 |

OTHER PUBLICATIONS

Chinese Office First Action dated Apr. 20, 2017 for Application No. 201410668527.1.

* cited by examiner

LOUDSPEAKER MODULE

TECHNICAL FIELD

The present disclosure relates to the technical field of electroacoustic products, and particularly to a loudspeaker module.

BACKGROUND

A loudspeaker module is an important acoustic component in a portable electronic device and used to perform the conversion between an electrical signal and a sound signal, and serves as an energy conversion device. A loudspeaker module usually comprises a module casing in which a loudspeaker unit body is received, and the loudspeaker unit body needs to be fixed in a module inner cavity by a positioning structure. In the current loudspeaker module, the positioning of the loudspeaker unit body in the module inner cavity is usually ensured by the squeezing between a retaining wall disposed on the module casing and the upper and lower casings of the module. However, as portable electronic devices constantly become light-weighted, thinner and slimmer, the loudspeaker module must become increasingly thinner and smaller and therefore the space in the loudspeaker module becomes increasingly smaller and smaller. If the retaining wall is still used for positioning in the increasingly smaller module inner cavity, it occupies a very large portion of the module inner cavity space, so the acoustic cavity of the module is reduced and the acoustic performance of the loudspeaker module falls.

SUMMARY

In view of the above drawbacks, the technical problem to be solved by the present disclosure is to provide a loudspeaker module which saves the internal space of the module to a maximum degree while ensuring the effective positioning of the loudspeaker unit, and improves the acoustic performance of the loudspeaker module.

To solve the above technical problem, the present disclosure employs the following technical solutions:

a loudspeaker module comprising a module casing, a loudspeaker unit body being accommodated within the module casing, the loudspeaker unit body comprising a unit body front cover and a unit body casing, which are engaged together, a vibration system and a magnetic circuit system being accommodated within a space enclosed by the unit body front cover and the unit body casing, a plurality of positioning columns are arranged outside sidewalls of the unit body casing, each of the positioning columns protrudes out of a surface of the sidewall of the unit body casing, and extends from an upper end of the unit body casing to a lower end of the unit body casing along the sidewall of the unit body casing; positioning bosses are individually arranged at positions on the module casing corresponding to the positioning columns, and positioning holes which are adapted for the positioning columns are individually vertically arranged on the positioning bosses.

Preferably, a lower end face of each of the positioning columns is provided with an ultrasonic line, and each of the positioning columns is engaged with the module casing by an ultrasonic welding process.

Preferably, the positioning columns and the unit body casing are of a unitary structure.

Preferably, the loudspeaker unit body is of a rectangular structure, and each of said positioning columns is disposed on one of four sidewalls of the unit body casing.

Preferably, the positioning columns each are disposed at a middle position of a corresponding sidewall of the unit body casing.

Preferably, the module casing comprises an upper casing and a lower casing, which are engaged together, and each of said positioning bosses is disposed inside the lower casing.

Preferably, the lower casing is of a box-shaped structure with an upper end open, and each of said positioning bosses is disposed on an inside bottom of the lower casing.

Preferably, the positioning columns are engaged with the inside bottom of the lower casing by ultrasonic welding.

Preferably, cross sections of the positioning columns and the positioning holes are both of a circular structure.

The present disclosure achieves the following advantageous effects by employing the above technical solutions:

In the present disclosure, the loudspeaker module comprises the module casing, the loudspeaker unit body is accommodated in the module casing, a plurality of positioning columns are disposed outside the sidewalls of the unit body casing of the loudspeaker unit body, the positioning bosses are disposed on the module casing, and the positioning bosses are provided with the positioning holes adapted for the positioning columns. Hence, the loudspeaker unit body is fixed in the module inner cavity in a way that the positioning columns mate with the positioning holes. As compared with the retaining wall in the prior art, the positioning structure in which the positioning columns mate with the positioning holes is small in size, occupies a small space, saves the space of the acoustic chamber of the module to a maximum degree while achieving the positioning of the loudspeaker unit body in the X direction and the Y direction (horizontal direction), and improves the acoustic performance of the module.

A lower end face of each of the positioning columns is provided with an ultrasonic line, and each of the positioning columns is engaged with the module casing by an ultrasonic welding process. That engagement manner improves the positioning effect, and enhances firmness of the engagement between the loudspeaker unit body and the module casing. Meanwhile, ultrasonic welding process is cleaner and easier to operate as compared with other manners such as bonding by applying a glue or hot melting bonding process, and simplifies the assembling process of the module.

To conclude, the loudspeaker module in the present disclosure solves the technical problem that the positioning structure of the loudspeaker unit body in the prior art occupies a large space. The unit body positioning structure in the loudspeaker module in the present disclosure has a small structure and occupies a small space. The module exhibits a high acoustic performance and the assembling process of the module is simple and easy to operate.

The above depictions are only the generalization of the technical solutions of the present disclosure, which may be implemented according to the content of the description to make the technical means of the present disclosure clearer. Specific embodiments of the present disclosure are presented below to make the above and other objects, features and advantages of the present disclosure more apparent.

BRIEF DESCRIPTION OF THE DRAWINGS

Various other advantages and merits will become apparent to those skilled in the art by reading through the following detailed description of preferred embodiments. Figures are only intended to illustrate preferred embodiments and not construed as limiting the present disclosure. In the figures.

In the figures, the reference number 10 denotes upper casing, 12 sound exit hole, 20 lower casing, 22 positioning boss, 220 seat, 222 positioning hole, 30 loudspeaker unit body, 32 unit body front cover, 34 unit body casing, 340 positioning column, 342 ultrasonic line, 360 diaphragm, 362 dome, 364 voice coil, 380 magnetic conducting plate, 382 inner magnet, 384 inner washer, 386 outer magnet, 388 outer washer, 40*a* foam, and 40*b* foam.

DETAILED DESCRIPTION

The present disclosure will be further illustrated with reference to figures and embodiments.

The orientation "upper" involved in the present description refers to the direction of the vibration system of the loudspeaker unit body, and the orientation "lower" refers to the direction of the magnetic circuit system of the loudspeaker unit body. "Inside" the module casing involved in the present description refers to the side located within the module inner cavity, and "outside" refers to the side located out of the module inner cavity. "Inside" the unit body casing involved in the present description refers to the side located within the unit body inner cavity, and "outside" refers to the side located out of the unit body inner cavity.

Figure 1:
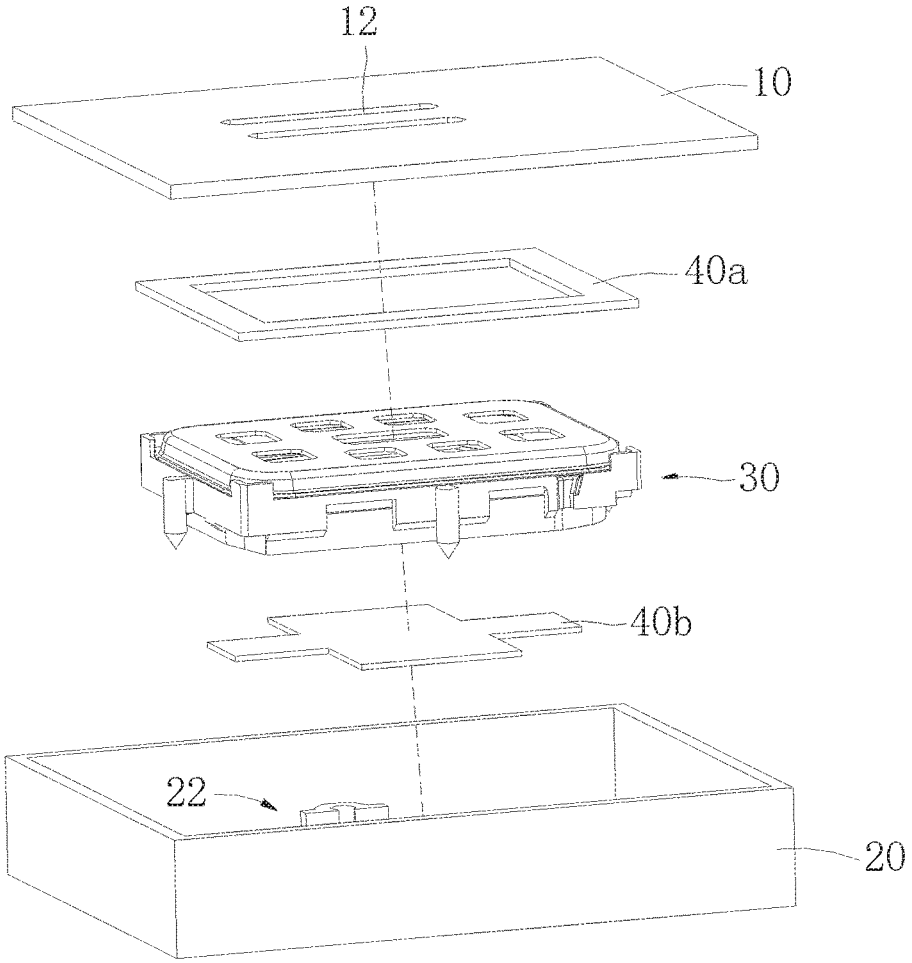
FIG. 1 is a three-dimensional exploded structural schematic view of a loudspeaker module according to the present disclosure.
Figure 2:
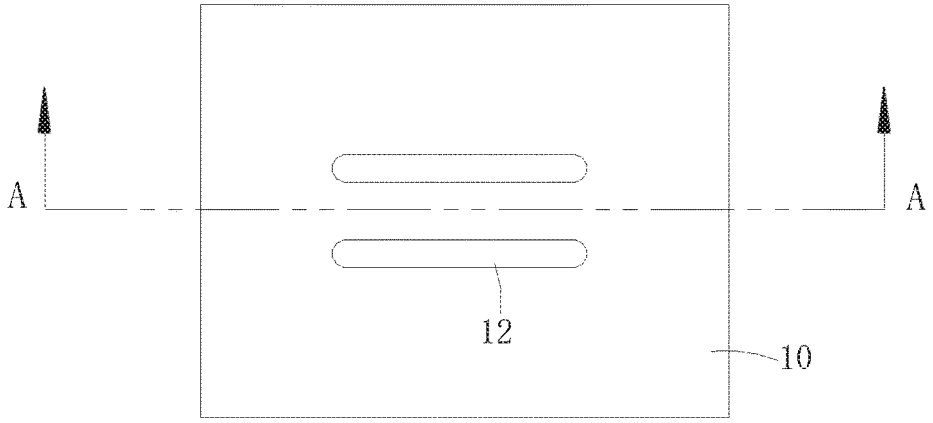
FIG. 2 is a combination view of FIG. 1.

As jointly shown in FIG. 1 and FIG. 2, a loudspeaker module is of a rectangular structure and comprises a module casing, the module casing comprises an upper casing 10 and a lower casing 20, which are engaged together, and a loudspeaker unit body 30 is received in a space enclosed by the upper casing 10 and the lower casing 20. An annular foam 40*a* is disposed between the loudspeaker unit body 30 and the upper casing 10, the foam 40*a* functions to seal a front acoustic chamber and a rear acoustic chamber, the space between the foam 40*a* and a sound exit surface of the loudspeaker unit body 30 and the upper casing 10 is the front acoustic chamber of the module, and the remaining space enclosed by the upper casing 10 and lower casing 20 is the rear acoustic chamber of the module. A sound exit hole 12 is disposed at a position on the upper casing 10 corresponding to the front acoustic chamber, and the sound from the loudspeaker unit body 30 radiates through the sound exit hole 12 to the outside of the module. A foam 40*b* is disposed between the loudspeaker unit body 30 and the lower casing 20.

As jointly shown in FIG. 1, FIG. 3, FIG. 4 and FIG. 5, the loudspeaker unit body 30 is also of a rectangular structure and comprises a unit body front cover 32 and a unit body casing 34, which are engaged together. A vibration system and a magnetic circuit system are accommodated within the space enclosed by the unit body front cover 32 and the unit body casing 34. Four positioning columns 340 are disposed outside sidewalls of the unit body casing 34 and individually disposed at a middle position of four sidewalls of the unit body casing 34. The four positioning columns 340 are all of a cylindrical structure protruding out of the surface of the sidewall of the unit body casing 34, the four positioning columns 340 all extend from the upper end of the unit body casing 34 to the lower end of the unit body casing 34 vertically along the sidewall of the unit body casing 34, the upper halves of the positioning columns 340 are integral with the unit body casing 34, and the lower end faces of the positioning columns 340 are provided with a conical ultrasonic line 342. The lower casing 20 is of a box-shaped structure with an open upper end, the bottom of the lower casing 20 is provided with four positioning bosses 22 individually adapted for the four positioning columns 340, each of the positioning bosses 22 comprises an arch-shaped seat 220 placed flat, the straight sides of the seat 220 are disposed adjacent to the loudspeaker unit body 30 and its arcuate sides are disposed away from the loudspeaker unit body 30. Cylindrical positioning holes 222 are provided vertically at the positions of the seat 220 corresponding to the positioning columns 340, openings are provided at the position of the seat 220 corresponding to the connections of the positioning columns 340 and the unit body casing 34, and the openings vertically run through the seat 220. When the loudspeaker module is being assembled, the four positioning columns 340 are individually inserted into the four positioning holes 222, and then the positioning columns 340 are engaged together with the bottom of the lower casing 20 by an ultrasonic welding process, whereby the loudspeaker unit body 30 is fixed to the lower casing 20. The positioning structure by which the positioning columns are engaged with the positioning boss is small in size, occupies a small space, saves the space of the acoustic chamber of the module to a maximum degree while achieving the positioning of the loudspeaker unit body, and improves the acoustic performance of the module.

Figure 3:
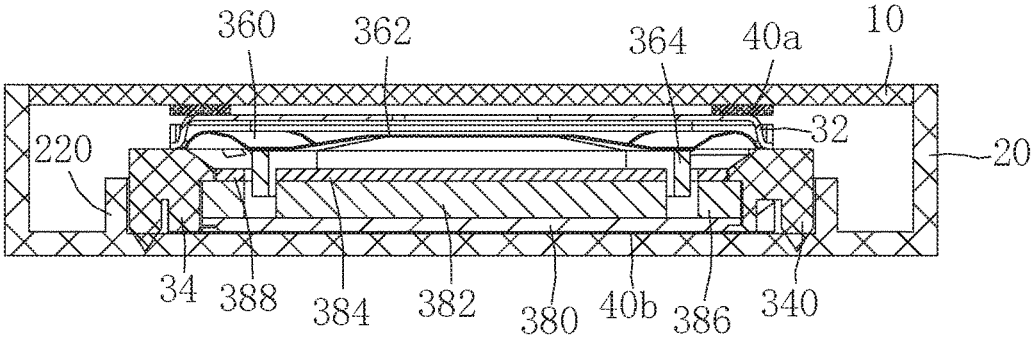
FIG. 3 is an enlarged cross-sectional view taken along the line A-A of FIG. 2.

As shown in FIG. 3, the vibration system of the loudspeaker unit body comprises a diaphragm 360 whose edge is fixed between the unit body front cover 32 and the unit body casing 34, a dome 362 protruding towards the unit body front cover 32 is fixed at the middle portion of the diaphragm 360, and a voice coil 364 is disposed on the side of the diaphragm 360 adjacent to the magnetic circuit system. The magnetic circuit system comprises a magnetic conducting plate 380 fixed on the unit body casing 34, an inner magnet 382 and an inner washer 384 are disposed in turn at the middle position inside the magnetic conducting plate 380, an outer magnet 386 and an outer washer 388 are fixed in turn at the edge position inside the magnetic conducting plate 380, and the outer magnet 386 and the outer washer 388 surround the outer circumferences of the inner magnet 382 and the inner washer 384. The inner magnet 382 and the inner washer 384 constitute the inner magnetic circuit of the loudspeaker unit body, the outer magnet 386 and the outer washer 388 constitute the outer magnetic circuit of the loudspeaker unit body, a magnetic gap is provided between the inner magnetic circuit and the outer magnetic circuit, and an end of the voice coil 364 is located in the magnetic gap. The voice coil 364 makes reciprocating up-down movements in the magnetic gap according to the magnitude and the direction of the sound wave electrical signal running through the windings thereof, the diaphragm 360 vibrates along with the up-down movements of the voice coil 364, urges air to generate a sound and thereby completes electroacoustic energy conversion.

Figure 5:
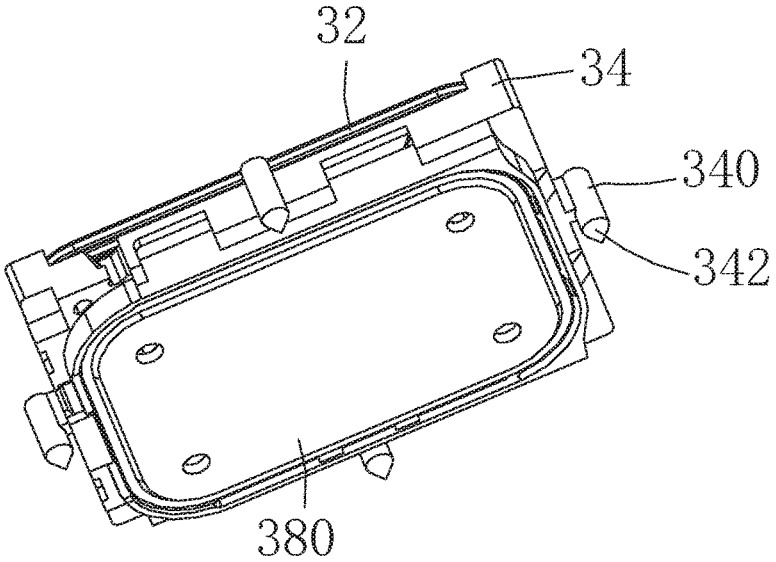
FIG. 5 is a structural schematic view of a loudspeaker unit body in FIG. 1.

As jointly shown in FIG. 3 and FIG. 5, the unit body casing 34 is of an annular structure with two ends open, the magnetic conducting plate 380 is fixed at an open location of the lower end of the unit body casing 34, and the outer surface of the magnetic conducting plate 380 flushes with the lower end face of the unit body casing 34, thereby effectively reducing the thickness of the loudspeaker unit body and thereby effectively reducing the thickness of the loudspeaker module.

Figure 4:
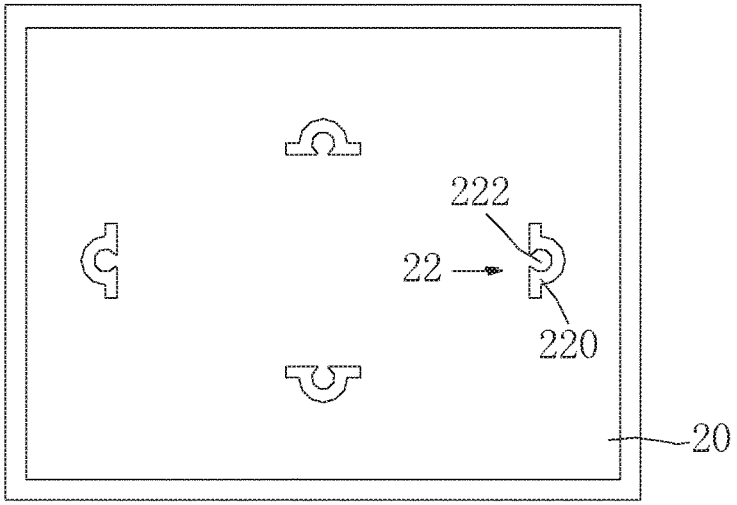
FIG. 4 is a planar structural schematic view of a lower casing in FIG. 1.

As jointly shown in FIG. 4 and FIG. 5, in the present embodiment the positioning columns 340 are designed as a cylindrical structure because the positioning columns with the cylindrical structure are convenient to process, occupy a smaller space and are a preferred solution of the present disclosure. However, the structure of the positioning columns is not limited to the cylindrical structure, and a column with for example a triangular, square or other polygonal cross section may realize the positioning function.

As shown in FIG. 5, in the present embodiment one positioning column 340 is disposed on each of the four sides of the loudspeaker unit body, which may well implement the positioning of the loudspeaker unit body in the X direction and the Y direction in the module. The solution in which one positioning column is disposed on each of the four sides is a preferred solution, which is selected by those skilled in the art according to the structure and the requirements on the positioning of the loudspeaker unit body and the loudspeaker module. In practical application the number and positions of the positioning columns are not limited to the above solutions. Those skilled in the art may change them according to the structure and the requirements on the positioning of the loudspeaker unit body and the loudspeaker module.

In the present embodiment, the solution of the present disclosure is described in detail by taking the loudspeaker unit body and module with a rectangular structure as an example, but the technical solution of the present disclosure that the positioning columns are disposed on the unit body casing and the positioning structures matching the positioning columns are disposed on the module casing are used to save the acoustic chamber space of the module is not limited to the module with that structure, and that solution applies to any module with a unit body being provided with a casing. Those skilled in the art may, according to the depictions of the description and without making any inventive efforts, apply the technical solution of the present disclosure to modules with other structures, including modules with a round structure, a track-shaped structure or a structure of other irregular shapes. Hence, no matter whether other structures of the module and the unit body are identical with what are described in the above embodiments, a loudspeaker product falls within the protection scope of the present disclosure so long as the positioning columns are disposed on the unit body casing, and the positioning structures matching the positioning columns are disposed on the module casing, and as well the loudspeaker product is used to save the acoustic chamber space of the module and improve the acoustic performance of the module.

The present disclosure is not limited to the above specific embodiments, and diverse variations made by those skilled in the art starting from the above concept without making any inventive efforts all fall within the protection scope of the present disclosure.

The invention claimed is:

1. A loudspeaker module, comprising a module casing, the module casing comprises an upper casing and a lower casing which are engaged together, a loudspeaker unit body being accommodated within the space enclosed by the upper casing and the lower casing, the loudspeaker unit body comprising a unit body front cover and a unit body casing, which are engaged together, a vibration system and a magnetic circuit system being accommodated within a space enclosed by the unit body front cover and the unit body casing, wherein a plurality of positioning columns are arranged outside sidewalls of the unit body casing, each of the positioning columns protrudes out of a surface of the sidewall of the unit body casing, and extends from an upper end of the unit body casing to a lower end of the unit body casing along the sidewall of the unit body casing; positioning bosses are individually arranged at positions on an inside bottom of the lower casing corresponding to the positioning columns, the positioning bosses comprises an arch-shaped seat placed flat, openings are provided at the position of the seat corresponding to the connections of the positioning columns and the unit body casing, the openings vertically run through the seat, and positioning holes which are adapted for the positioning columns are individually vertically arranged on each seat.

2. The loudspeaker module according to claim 1, wherein a lower end face of each of the positioning columns is provided with an ultrasonic line, and each of the positioning columns is engaged with the module casing by an ultrasonic welding process.

3. The loudspeaker module according to claim 2, wherein upper halves of the positioning columns and the unit body casing are of a unitary structure.

4. The loudspeaker module according to claim 3, wherein the loudspeaker unit body is of a rectangular structure, and each of said positioning columns is disposed on one of four sidewalls of the unit body casing.

5. The loudspeaker module according to claim 4, wherein the positioning columns each are disposed at a middle position of a corresponding sidewall of the unit body casing.

6. The loudspeaker module according to claim 2, wherein the positioning columns are engaged with the inside bottom of the lower casing by ultrasonic welding.

7. The loudspeaker module according to claim 6, wherein cross sections of the positioning columns and the positioning holes are both of a circular structure.

8. The loudspeaker module according to claim 1, wherein the lower casing is of a box-shaped structure with an upper end open.

9. The loudspeaker module according to claim 1, wherein the unit body casing is of an annular structure with two ends open, a magnetic conducting plate is fixed at an open location of a lower end of the unit body casing, and the outer surface of the magnetic conducting plate flushes with a lower end face of the unit body casing.

10. The loudspeaker module according to claim 1, wherein straight sides of the seat are disposed adjacent to the loudspeaker unit body and arcuate sides of the seat are disposed away from the loudspeaker unit body.

11. The loudspeaker module according to claim 1, wherein a first annular foam is disposed between the loudspeaker unit body and the upper casing, and a second foam is disposed between the loudspeaker unit body and the lower casing.

* * * * *